US007975591B2

(12) United States Patent
Baeumer

(10) Patent No.: US 7,975,591 B2
(45) Date of Patent: Jul. 12, 2011

(54) BRAIDING BOBBIN, BRAIDING MACHINE AND METHOD FOR DRAWING OFF A FIBER FROM THE SPOOL OF A BRAIDING BOBBIN

(75) Inventor: Thomas Baeumer, Hueckelhoven (DE)

(73) Assignee: Enrichment Technology Company, Ltd., Juelich (DE)

( * ) Notice: Subject to any disclaimer, the term of this patent is extended or adjusted under 35 U.S.C. 154(b) by 0 days.

(21) Appl. No.: 12/542,189

(22) Filed: Aug. 17, 2009

(65) Prior Publication Data

US 2010/0037759 A1 Feb. 18, 2010

(30) Foreign Application Priority Data

Aug. 18, 2008 (DE) ..... 10 2008 038 281

(51) Int. Cl.
*D04C 3/14* (2006.01)

(52) U.S. Cl. ..... 87/57; 87/61

(58) Field of Classification Search ..... 87/55, 56, 87/57, 61

See application file for complete search history.

(56) References Cited

U.S. PATENT DOCUMENTS 3,682,413 A * 8/1972 Klimek ..... 242/156.2
5,000,397 A 3/1991 Darrieux
5,732,611 A * 3/1998 Voyer et al. ..... 87/56

FOREIGN PATENT DOCUMENTS

DE 316 235 A 11/1919
DE 1 435 219 A1 5/1969
EP 0 402 526 B1 12/1990

OTHER PUBLICATIONS

German Office Action issued Application No. 10 2008 038 281.7-26, dated Sep. 18, 2009.

* cited by examiner

*Primary Examiner* — Shaun R Hurley
(74) *Attorney, Agent, or Firm* — Venable LLP; Robert Kinberg; Leigh D. Thelen

(57) ABSTRACT

A braiding bobbin includes a shaft and a spool from which a fiber thread can be drawn off through a thread guide mounted to rotate on the shaft. At least one torsion spring joins the shaft and the spool to each other. The spool is rotatable in a draw-off direction against the spring force and in an opposite, backwinding direction by the spring force of the torsion spring. A brake having an adjustable braking torque brakes rotation of the shaft in the draw-off direction.

9 Claims, 2 Drawing Sheets

BRAIDING BOBBIN, BRAIDING MACHINE AND METHOD FOR DRAWING OFF A FIBER FROM THE SPOOL OF A BRAIDING BOBBIN

CROSS-REFERENCE TO RELATED APPLICATION

This application claims the priority of German Patent Application No. DE 10 2008 038 281.7, filed on Aug. 18, 2008, the subject matter of which is incorporated herein by reference.

BACKGROUND

The invention relates to a braiding bobbin having a spool from which a fiber thread can be drawn off through a thread guide. The invention also relates to a braiding machine having several such braiding bobbins, and to a method for drawing off a fiber thread from a spool of a braiding bobbin.

Braiding machines normally make use of braiding bobbins with spools and thread guides with which the thread tension of the fibers is supposed to be kept as constant as possible during the braiding procedure. Particularly in the case of braiding machines in which very fine carbon fibers are processed, this procedure has to be very gentle on the fibers since otherwise the fibers can be damaged or even break.

Prior-art braiding bobbins differ substantially from each other in terms of the fiber spool employed. Braiding machines use either elongated fiber spools that hold quite a large volume of fiber material or else a short spool is used that can accommodate very fine fiber material, although only in smaller quantities. Both systems work in the same way in that, for example, an elongated spool with the previously wound-up fiber material is placed into the braiding bobbin and locked in place. The thread is guided through a thread guide that is positioned approximately in the center at the height of the fiber spool. From there, the thread is guided to a thread deflector at the foot of the bobbin, whereby this fiber deflector is integrated into a lever that is spring-loaded and that releases a ratchet at a given spring tension. This ratchet is located below the fiber spool and is joined to it by means of a clamping shaft. When the ratchet is released, the bobbin is allowed to rotate and the spool rotates under the fiber tension that is present. The rotation of the spool releases a length of fiber and the thread tension is abruptly reduced. The spring-loaded lever moves downwards, locking the ratchet again and thus also the fiber spool. As more fiber is drawn off, the procedure is repeated until the fiber tension has lifted the lever to such an extent that it releases the ratchet.

The course of the fiber tension has the form of a sawtooth. The thread tension rises relatively steeply as a function of the spring constant until the ratchet is released by the spring-loaded thread deflection lever. When the spool is released, it can roll freely over a catch and the thread tension drops briefly and steeply. The spool is then braked again until the next catch is released. When the bobbin moves from the outer radius of the bobbin curve towards the inner radius, the thread tension drops again as a function of the spring constant. This procedure is continuously repeated during the braiding procedure.

The spring-loaded lever and the associated fiber path are absolutely necessary for the braiding procedure because this is the only way in which the spring tension can be maintained at every point in time. The meandering course of the braiding bobbin in the braiding machine, however, gives rise to different fiber lengths from the fiber spool to the plaiting point. When the bobbin moves from the outer radius of the bobbin trajectory towards the inner radius, the fiber length decreases towards the braiding point. Without the thread compensation in the braiding bobbin, the thread would sag and be carried along by the other threads.

One drawback of elongated fiber spools is that the thread is drawn off at a slant above the wound-up fiber supply because of the short distance of the first thread guide. Consequently, in the case of sensitive fibers such as, for instance, carbon fibers, fiber damage occurs quite readily, building up and ultimately causing the fibers to break.

Therefore, in the case of sensitive fibers such as carbon fibers having a very low tex number, short spools are normally employed that allow a less problematic drawing off of the fibers. A disadvantage of shorter spools lies in the smaller amount of fiber that can be wound onto a spool. Since only very fine fibers can be processed with such spools, however, a sufficient length of fiber is available on the spool for the braiding procedure. Owing to the arrangement of the spool, however, the thread compensation path has to be solved in a different way. This is normally done by means of a multiple fiber deflector and a pulley principle provides sufficient fiber length for the length compensation. However, the large number of fiber deflectors inside the bobbin take-off has been found to be a drawback in such constructions. Typically, the thread passes four times through a fiber deflector of 180° and through an eyelet-shaped thread guide. Especially with the 180° fiber deflectors, fiber damage occurs that can then lead to fiber breaks.

For purposes of maintaining a predetermined fiber tension during braiding processes, it is likewise a known procedure to employ torsion springs inside a spool. For instance, European patent specification EP 0 402 526 B1 discloses a fiber-winding machine having a supply spool and an axle member with a coil spring inside it. The coil spring is operatively associated with the interior of the axle member and its outer end is in engagement with recessed portions located inside the drive part of the supply spool. When the axle member and the supply spool are rotated, the outer end of the coil spring is in engagement with one recessed portion in order to wind the spring up to a predetermined tension. Subsequently, continued rotation of the axle member and of the spool in the same direction causes the outer end of the spring to slip from one recessed portion to another to prevent overwinding or breaking of the spring. If sagging occurs during the fiber feed, the outer end of the spring is in engagement with a recessed portion and the axle member and the spool rotate in the opposite direction so as to wind the fiber onto the supply spool and to maintain a predetermined tension on the fiber.

Likewise known from the state of the art are various applications of brake devices that control the rotation of spools. For example, German Preliminary Published Application DE 1 435 219 A1 discloses a bobbin for a braiding machine in which several spools are mounted on a shared tension shaft in such a way that they can be rotated and braked. Here, the rotational axis of the spools coincides with the axis of the braking device. A spring that exerts a load on the brake assists the function of the brake.

The prior-art spool shapes of braiding bobbins, however, do not allow the processing of very fine carbon fibers without the occurrence of damage to the fibers. The dry fiber processing, along with the fiber-damaging draw-off, does not allow a reliable braiding process to be set up, especially when a large number of fiber spools are to be used at the same time.

SUMMARY OF THE INVENTION

Therefore, the objective of the invention is to put forward a braiding bobbin with which the requisite thread tension can be set and a thread compensation of a sufficient magnitude is present, without this leading to extensive fiber damage, especially in the case of sensitive fibers.

The above and other objectives are accomplished according to the invention by the provision of a braiding bobbin, comprising: a shaft; a spool from which a fiber thread can be drawn off through a thread guide, the spool being mounted to rotate on the shaft; at least one torsion spring joining the shaft and the spool to each other, the spool being rotatable in a draw-off direction against the spring force and in an opposite, backwinding direction by the spring force of the torsion spring; and a brake having an adjustable braking torque to brake rotation of the shaft in the draw-off direction.

In one embodiment of the invention, the torsion spring is affixed to the inner surface of a hollow spool holder and to the outer surface of a sleeve, whereby the spool holder is rotatably mounted on bearings on the sleeve, whereas the sleeve is non-rotatably attached to the shaft and the spool, in turn, is non-rotatably attached to the spool holder.

The spool may be arranged in a laterally open housing frame of the braiding bobbin that can be configured, for example, as a U-section. The thread guide in the form of a cutout is created in an upper leg of the housing frame and the shaft is rotatably attached in a hole in the intermediate partition of the housing frame. The brake may be, for example, a magnetic hysteresis brake or an eddy-current brake. The brake can be situated inside or outside of the housing frame of the braiding bobbin, whereby the shaft passes through the housing to the brake if it is situated outside of the housing.

The invention also encompasses a braiding machine comprising several of the braiding bobbins according to the invention.

The invention also encompasses a method to draw off a fiber thread from the spool of a braiding bobbin, whereby, during the braiding operation, the fiber thread is drawn off from the spool in a first process step i), as a result of which the spool is rotated on a shaft against the spring force of a torsion spring in the draw-off direction. As soon as the torque on the shaft matches the braking torque set for a brake of the shaft, the rotation of the spool causes the shaft to rotate by means of the torsion spring. In a second process step ii), the fiber thread is wound back onto the spool in that the shaft is stationary and the spool is rotated by the spring force of the torsion spring on the shaft in a backwinding direction that is opposite to the draw-off direction.

The braiding bobbin according to the invention has the advantage that it can process especially a large number of sensitive fibers in a braiding machine without this causing damage to the fiber. In this process, the fiber can be drawn off from the spool without being damaged, whereby the requisite fiber tension can be adjusted and only slight tension fluctuations occur. Moreover, sufficient thread compensation is present and the fiber is drawn off very uniformly.

In this context, the fiber spool allows thread compensation even by means of a reverse rotational movement. The thread tension is effectuated by an adjustable brake and the redrawing movement is achieved by a torsion spring while a certain thread tension is maintained.

BRIEF DESCRIPTION OF THE DRAWINGS

Additional advantages, special features and practical refinements of the invention may be discerned from the following detailed description embodiments of the invention, with reference to the accompanying drawings.

DETAILED DESCRIPTION

Figure 1:
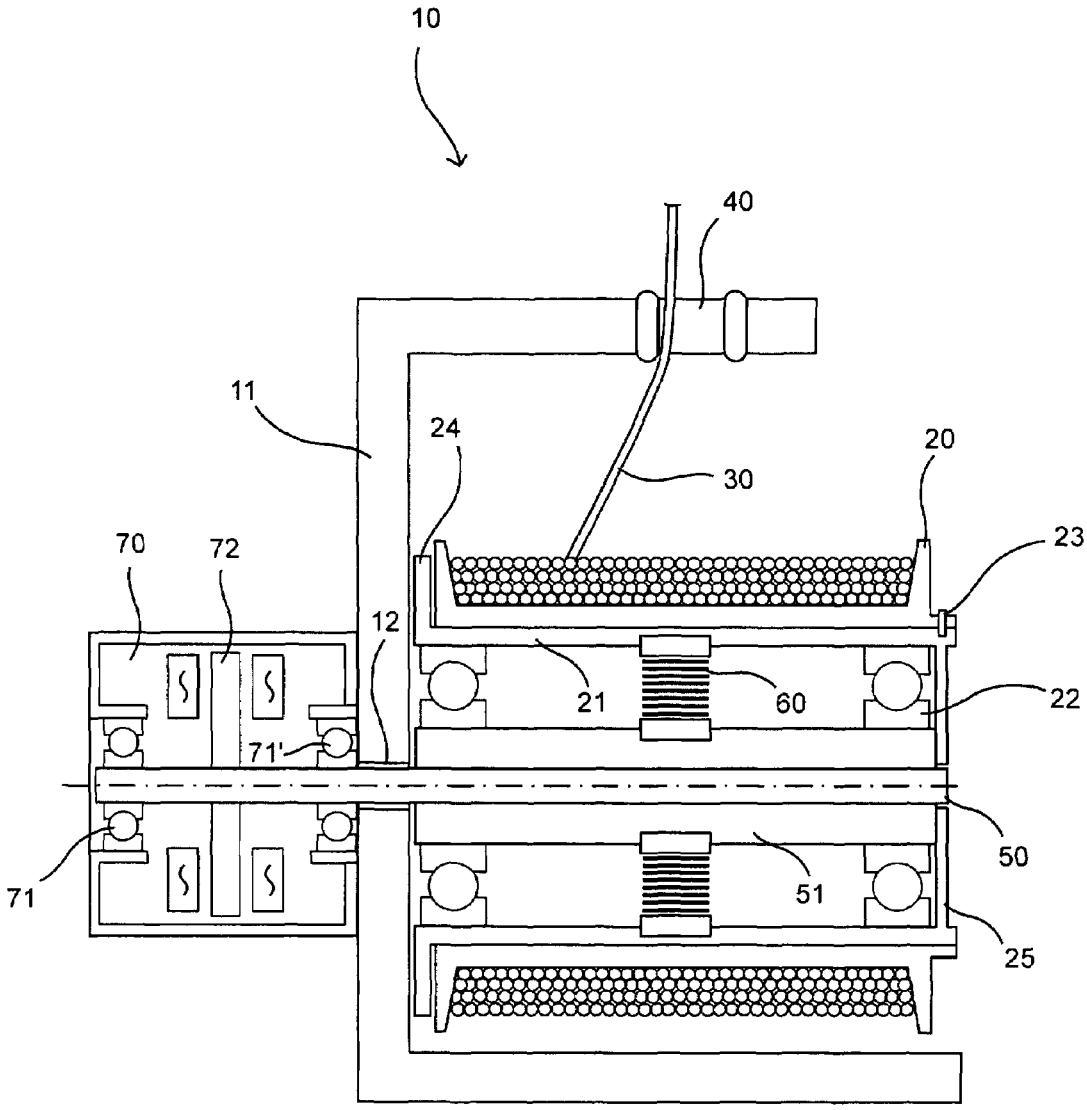
FIG. 1 is diametrical sectional view an embodiment of the braiding bobbin according to the invention.

FIG. 1 shows an embodiment of the braiding bobbin 10 according to the invention in which a spool 20 is arranged inside a laterally open housing frame 11 of the braiding bobbin 10. Fiber material in the form of a fiber thread 30 is wound onto the spool, and radial elevations to prevent the fiber material from sliding off sideways can be provided on the faces of the spool 20. The spool 20 is preferably hollow and is slid onto a spool holder 21 from the side. One face of the spool holder 21 is covered by the housing frame 11 while the other face is exposed so that the spool 20 can be wound up and drawn off from this open side. The spool 20 as well as the spool holder 21 are made, for instance, of plastic.

The spool holder 21 is preferably configured to be hollow like the spool 20. The spool holder 21 surrounds a shaft 50 on which the spool holder 21 is mounted so that it can rotate in two directions. Bearings 22, for example, in the form of ball bearings, can be provided for this purpose. In a preferred embodiment of the invention, a sleeve 51 is firmly attached to the shaft 50 inside the spool holder 21. The bearings 22 support the spool holder 21 so that it can rotate on the sleeve 51 and thus on the shaft 50.

The spool holder 21 and the spool 20 can be non-rotatably connected to each other by, for example, a cotter pin 23 that may be inserted through a hole in the spool 20 and in the spool holder 21. The cotter pin 23 affixes the spool 20 on the spool holder 21 not only radially but also axially. In order to replace the spool, the cotter pin 23 is removed and the spool 20 can be taken off of the spool holder 21. When a new spool is to be installed, the two holes of the spool 20 and of the spool holder 21 have to be aligned with each other so as to allow the insertion of the cotter pin 23.

As an alternative or in addition, other mechanisms for non-rotatably connecting the spool 20 to the spool holder 21 can also be provided. For instance, the face of the spool holder 21 that is covered by the housing frame 11 can have a delimiting partition 24 into which one or more cutouts have been made. As a counterpart, the spool 20 can have one or more pins on its corresponding face, such pin(s) engaging with the cutouts when the spool is slid onto the spool holder 21 all the way to the delimiting partition 24. Here, too, the spool 20 has to be aligned with the spool holder 21. In order to ensure not only this radial connection but also an axial connection, the spool holder 21 can be configured, for example, with a conical shape, whereby its outer diameter increases towards the face in the area of the housing frame 11. The spool 20 can then be slid on from the thinner side and pressed onto the conical spool holder 21. It is likewise possible to provide a bayonet catch to connect the spool 20 and the spool holder 21.

At least one torsion spring 60 that surrounds the shaft 50 and establishes a connection between the spool holder 21 and the shaft 50 is arranged between the spool holder 21 and the shaft 50. If a sleeve 51 has been provided, the torsion spring 60 is preferably attached on the outer diameter of the sleeve 51 and on the inner diameter of the spool holder 21. The torsion spring 60 can be configured, for instance, as a coil spring. FIG. 1 shows a configuration of a straight torsion spring that is tightly clamped at both ends. The torsion spring 60 is arranged so that it exerts a spring force against the rotation of the spool 20 and thus of the spool holder 21 on the shaft 50 in the draw-off direction or so that it can bring about a rotation of the spool 20 on the shaft 50 in the opposite direction (backwinding direction).

The fiber thread 30 is guided from the spool 20 through a thread guide 40 out of the housing frame 11 of the braiding bobbin 10 to a plaiting point on a component that is to be braided. The thread guide in the form of an eyelet 40 is may be located in the upper area of the housing frame 11, as depicted in FIG. 1. In order not to cause any damage to the fiber thread 30 at the thread guide 40, the edges of the thread guide 40 may be configured to be rounded off. The surface of the eyelet 40 is also configured to be very smooth, so that no fiber damage can occur due to cracks, splinters or sharp burrs. Preferably, the eyelet is made of a material such as ceramics or porcelain.

The shaft 50 is rotatably mounted in a hole 12 in the housing frame 11 and protrudes from both sides of the housing frame 11. The spool holder 21 can be shaped on one end like a cover 25 in order to cover the inside of the spool. This embodiment is shown by way of an example in FIG. 1. The shaft 50 protrudes through a hole in the cover 25. The laterally open housing frame 11 is formed, for instance, by a U-profile in the two legs of the U-profile are arranged respectively above and below the shaft 50. The spool holder 21 and the spool 20 are arranged between the two legs of the U-profile, while the shaft 50 on the other side of the housing frame 11 is connected to a brake 70. In the embodiment of the invention shown in FIG. 1, this brake 70 is thus arranged to the left of the housing frame 11, and is attached to the outside of the housing frame 11. In an alternative embodiment of the invention, however, the brake 70 can also be arranged between the two legs of the housing frame 11, so that all of the components of the braiding bobbin are located inside the housing frame 11.

The brake 70 may be, for example, a magnetic hysteresis brake or an eddy-current brake with which the rotation of the shaft 50 can be braked. However, any other brake type can be used as an alternative to these kinds of brakes. For this purpose, a brake disc 72 can be installed on the shaft 50 inside the brake 70 and the rotation of the shaft in the draw-off direction is braked by the brake 70. A braking torque, for instance, within the range from 0 to 100 mNm, can be set on the brake 70. The shaft 50 is rotatably mounted inside the brake 70 by means of bearings 71 and 71'.

During the operation of the braiding bobbin in a braiding machine (not shown in greater detail in FIG. 1), several braiding bobbins are provided on a bobbin trajectory. The braiding bobbins move between the inner radius and the outer radius of the bobbin trajectory. When a braiding bobbin 10 moves from the inner radius of the bobbin trajectory towards the outer radius, the fiber thread 30 is drawn off from the spool 20 since the fiber length has to increase in this process. As the thread is being drawn off in the draw-off direction, the torsion spring 60 is tensioned against its spring force since the shaft 50 remains stationary due to the braking effect exerted by the brake 70. The torsion spring 60 is tensioned as a function of the stiffness of its spring until it reaches a spring tension at which, due to the torsion spring 60 on the shaft 50, a torque is exerted that corresponds to the braking torque to which the brake 70 has been set. Once this spring tension and thus the braking moment set in the brake 70 have been reached, the shaft 50 is moved along via the torsion spring 60 by the spool 20 so that it likewise turns. In this process, the fiber thread 30 continues to unwind from the spool 20. As long as the thread 30 is being drawn off from the spool 20, the thread tension is $F=M/r$ as a function of the spool diameter, wherein M stands for the braking moment that is exerted on the spool and r stands for the spool radius.

If the thread 30 has to be wound back, as is the case when the braiding bobbin 10 is guided from the outer radius to the inner radius of the bobbin trajectory, the tension on the thread 30 diminishes. The torsion spring 60 rotates the spool 20 in a backwinding direction that is opposite to the preceding draw-off direction. The thread 30 is wound back onto the spool 20 and the thread tension diminishes in this process as a function of the spring constant of the torsion spring 60, whereby the shaft 50 is stationary. Once the inner radius of the bobbin trajectory has been reached and the spool 20 once again runs from there towards the outer radius of the bobbin trajectory, the torsion spring 60 is tensioned again until the brake 70 releases the rotation of the shaft 50 again.

Figure 2A:
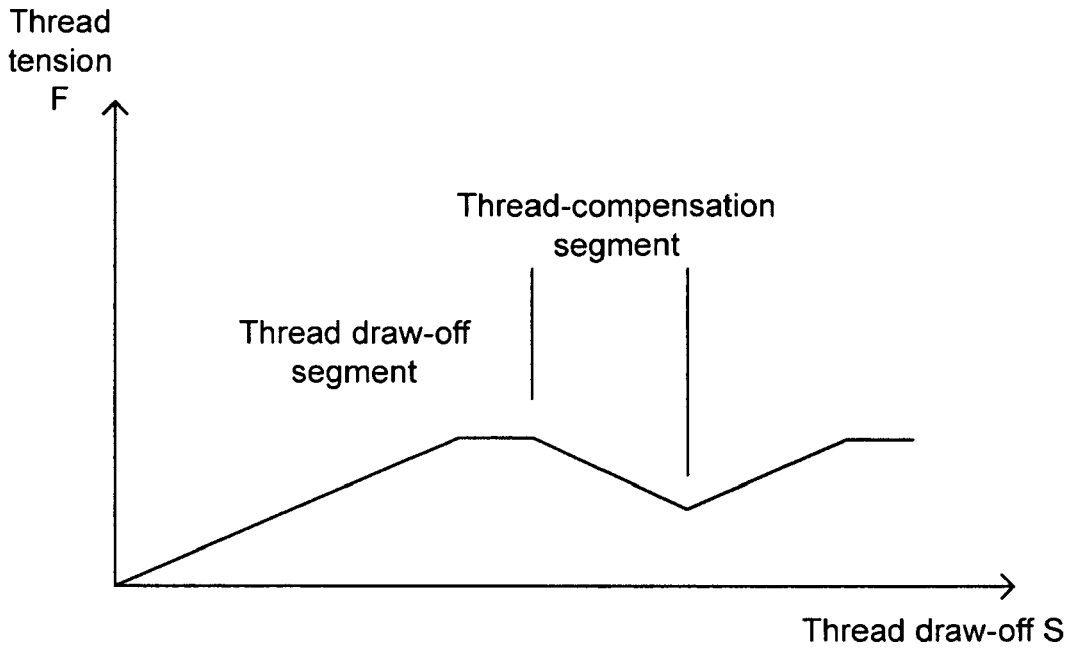
FIGS. 2A and 2B are diagrams of, respectively, the thread tension with the braiding bobbin according to the invention in comparison to a conventional braiding bobbin known from the state of the art.
Figure 2B:
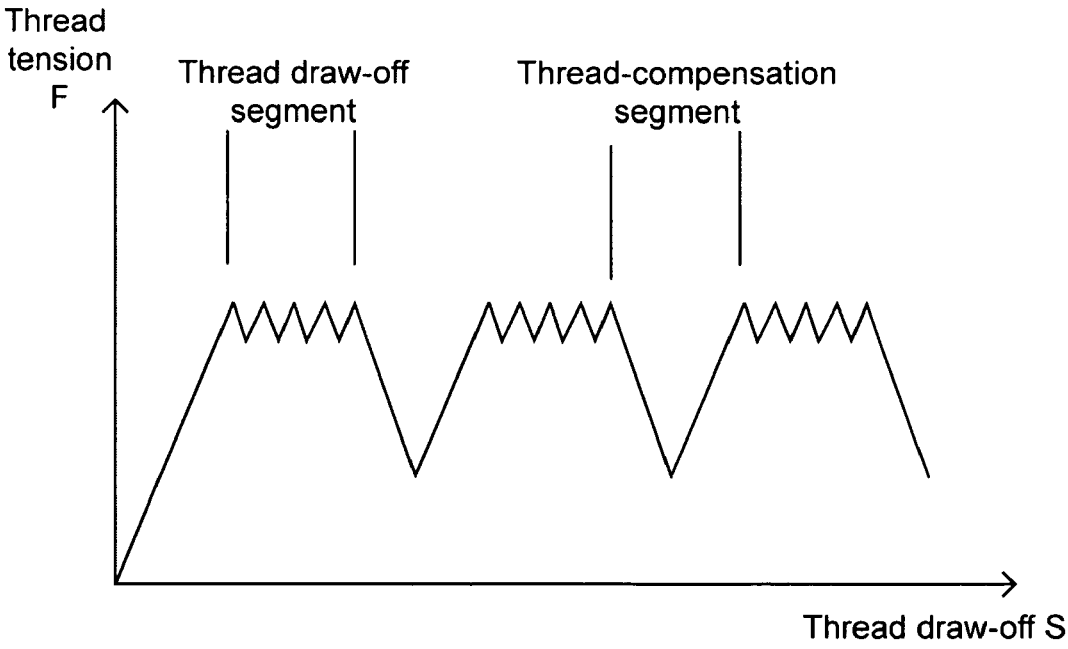
Fig. 2B (Prior Art)

The unwinding and backwinding procedure during the braiding of a component and the thread tension that occurs in this process are shown in FIG. 2A. The diagram in FIG. 2A shows the thread tension F plotted over the thread draw-off S. In comparison to this, the diagram in FIG. 2B depicts the thread tension for conventional braiding bobbins known from the state of the art. FIG. 2B shows the sawtooth-shaped course of the thread tension in conventional braiding bobbins which causes considerable stress on the fibers employed. Within the thread draw-off segment, repeated fluctuations in the tension occur when the spool rolls over a catch. When the bobbin moves from the outer radius to the inner radius of the bobbin curve, the thread compensation starts and the thread tension drops as a function of the spring constant of the thread deflection lever. The spring tension rises again on the way from the inner radius to the outer radius.

The course of the thread tension with the braiding bobbin according to the invention, in contrast, can be configured to be considerably flatter and thus gentler on the fiber through the selection of a given spring constant of the torsion spring 60. Until the shaft 50 is released by the brake 70, the thread tension within the thread draw-off segment rises continuously and then remains at a constant level while the thread 30 is being drawn off. When the thread is being backwound onto the spool within the thread-compensation segment, the thread tension drops again continuously and rises once again when the thread starts to be drawn off again.

Since no extensive fiber damage occurs with the braiding bobbin according to the invention, the braiding process can be carried out without problems with any number of fibers and braiding bobbins, whereby even sensitive fibers can be employed. If, for example, approximately 400 braiding bobbins are to be used in a braiding machine in order to meet certain requirements of a component that is to be braided, with the braiding bobbin according to the invention, that same number of carbon fibers having a tex weight of 77 (e.g. 1 K fiber T300 made by Toray) can be used without fiber damage or even fiber tears occurring.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A braiding bobbin, comprising:

a rotatable shaft;

a spool from which a fiber thread can be drawn off through a thread guide, the spool being mounted to rotate on the shaft;

at least one torsion spring joining the shaft and the spool to each other, the spool being rotatable in a draw-off direction against the spring force and in an opposite, backwinding direction by the spring force of the torsion spring; and a brake having an adjustable braking torque to brake rotation of the shaft in the draw-off direction, wherein the rotation of the spool causes the shaft to rotate via the torsion spring when a torque on the shaft matches the braking torque set for the brake.

2. The braiding bobbin according to claim 1, further including a hollow spool holder having an inner surface, the spool being non-rotatably attached to the spool holder; and a sleeve non-rotatably attached to the shaft, the spool holder being rotably mounted via bearings on the sleeve, wherein the torsion spring is affixed to the inner surface of the hollow spool holder and to the outer surface of the sleeve.

3. The braiding bobbin according to claim 1, wherein the brake comprises one of a magnetic hysteresis brake or an eddy-current brake.

4. The braiding bobbin according to claim 1, further comprising a laterally open housing frame in which the spool is arranged, wherein the housing frame comprises a U-profile with two legs connected by an intermediate section, wherein one of the legs has a cutout serving as the thread guide and the intermediate section has a hole in which the shaft is rotatably mounted.

5. The braiding bobbin according to claim 4, wherein the brake is arranged outside of the housing frame and the shaft passes through the hole in the housing frame to the brake.

6. The braiding bobbin according to claim 4, wherein the brake is arranged in the housing frame.

7. A braiding machine comprising a plurality of braiding bobbins according to claim 1.

8. A method to draw off a fiber thread from the spool of a braiding bobbin according to claim 1, comprising:

in a first process step, drawing off the fiber thread from the spool as a result of which the spool is rotated on the shaft against the spring force of the torsion spring in the draw-off direction, until the torque on the shaft matches the braking torque set for the brake of the shaft, and the rotation of the spool causes the shaft to rotate by means of the torsion spring; and in a second process step, winding the fiber thread back onto the spool in that the shaft is stationary and the spool is rotated by the spring force of the torsion spring on the shaft in a backwinding direction that is opposite to the draw-off direction.

9. The braiding bobbin according to claim 1, wherein the torsion spring is tightly clamped at both ends.

* * * * *